US005427366A

United States Patent [19]

Sakamori

[11] Patent Number: 5,427,366

[45] Date of Patent: Jun. 27, 1995

[54] SHEET FEEDING APPARATUS HAVING ADJUSTABLE GATE ROLLERS FOR CORRECTING SHEET SKEW

[75] Inventor: Katsuji Sakamori, Sagamihara, Japan

[73] Assignee: Kabushiki Kaisha Toshiba, Kawasaki, Japan

[21] Appl. No.: 124,604

[22] Filed: Sep. 21, 1993

[30] Foreign Application Priority Data

Mar. 10, 1993 [JP] Japan ..... 5-049541
Sep. 16, 1993 [JP] Japan ..... 5-229903

[51] Int. Cl.[6] ..... B65H 3/52
[52] U.S. Cl. ..... 271/125; 271/261
[58] Field of Search ..... 271/124, 125, 227, 228, 271/261, 122

[56] References Cited

U.S. PATENT DOCUMENTS 4,944,505 7/1990 Sherman, III ..... 271/227 X

FOREIGN PATENT DOCUMENTS 58-96209 6/1983 Japan .
64450 4/1984 Japan ..... 271/261
163247 9/1984 Japan ..... 271/261
242851 10/1988 Japan ..... 271/261
187151 7/1989 Japan ..... 271/261

*Primary Examiner*—David H. Bollinger
*Assistant Examiner*—Boris Milef
*Attorney, Agent, or Firm*—Cushman Darby & Cushman

[57] ABSTRACT

With a banknote processing apparatus, banknotes stored in a storing section are fed in a feeding direction one by one by take-in rollers. First and second sensors for detecting passage of the banknote are arranged in a direction perpendicular to the feeding direction of the sheets and spaced from each other. A difference between a first passing timing at which a leading edge of the banknote is detected by the first sensor and a second passing timing at which the leading edge of the banknote is detected by the second sensor is detected by a control section. A second difference between a passing timing at which a trailing edge of the banknote is detected by the first sensor and a passing timing at which the trailing edge of the banknote is detected by the second sensor is detected by the control section. If the first and second difference are different from each other, it is determined by the control section that a bent or torn portion exists in the banknote.

9 Claims, 11 Drawing Sheets

SHEET FEEDING APPARATUS HAVING ADJUSTABLE GATE ROLLERS FOR CORRECTING SHEET SKEW

BACKGROUND OF THE INVENTION

1. Field of the Invention

The present invention relates to a sheet processing apparatus utilized as, e.g., banking equipment.

2. Description of the Related Art

As a sheet processing apparatus, there is known a processing apparatus which is used for, e.g., discrimination of the denomination, discrimination of any damage, counting, discrimination of the authenticity, and the like of banknotes. A processing apparatus of this type generally has a banknote supply section in which banknotes to be processed are set, a discriminating section for discriminating the denomination, damage, and authenticity of banknotes supplied from the supply section, and for counting of the banknotes, a sorting section for sorting banknotes in accordance with the discrimination result, and a totaling section for storing the sorted banknotes.

The supply section has pick-up rollers for separating and feeding a banknote, and feed rollers and gate rollers for feeding the picked-up banknote. These rollers are made of an elastic member, e.g., rubber. Of a large number of banknotes set in the supply section, the lowermost banknote is picked up by the pick-up rollers and passed through the gap defined between the feed rollers and the gate rollers. When passing through the gap, banknotes following the first one that are picked up together with the lowermost banknote are stopped and separated from the lowermost banknote by the stopped or reversed gate rollers. Only one banknote is guided to a convey path by the feed rollers and sent to the storing section through the discriminating section.

The physical properties, e.g., the coefficient of friction, the rigidity, and the thickness, of a banknote largely change depending on the ambient environment or the influence of the usage period.

In one proposed arrangement, roller driving mechanisms are incorporated in the gate rollers so that the size of the gap between the feed rollers and the gate rollers can be adjusted. Hence, various types of banknotes set in the supply section can be stably fed even under complicated conditions. Also, even when a change occurs in the surface states of the respective rollers, e.g., a change in the coefficient of friction caused by wear or deterioration over time of rubber, it will not become difficult to reliably feed the banknotes one by one.

More specifically, a pair of sensors each having light-emitting and light-receiving portions are provided on the right and left sides of the convey path in the convey direction. A time required after a feed start reference signal is generated until a banknote blocks the optical path of either sensor and a time required after one sensor is blocked by a banknote until the other sensor is blocked are measured. Based on the time difference between these two measured times, convey information, e.g., pitch variations (variations in time required for feeding banknotes) or skew of banknotes conveyed along the convey path, is detected.

The gate rollers are slightly moved upward or downward based on the convey information, so that the size of the gap defined between the fed rollers and the gate rollers is adjusted. Then, each banknote conveyed along the convey path is fed in an optimum state.

In the detecting method described above, however, when a corner of a banknote is bent or an edge of a banknote is torn, the convey information, e.g., pitch variations or skew of the banknote may be undesirably erroneously detected. If the gap is adjusted based on the erroneous information, it is more likely that a banknote jam undesirably occurs or more than one banknotes are undesirably fed simultaneously.

Japanese Patent Application KOKAI Publication No. 58-96209 discloses an apparatus wherein a line sensor is arranged in a direction perpendicular to a feeding direction of the sheets and scans the sheet in a direction perpendicular to the feeding direction. Based on the detection results of the line sensor, a CPU detects a first skew amount of a side edge of the sheet extending in the feeding direction and a second skew amount of the opposite side edge of the sheet, and compares the first and second skew amount with each other. Then, the CPU selects smaller one of the first and second skew amount as a final skew amount and controls the feeding state of the sheets based on the selected skew amount.

The above-mentioned apparatus can distinguish between a sheet which is being skewed and deformed and a sheet which is being skewed but not deformed. However, since the apparatus selects smaller one of the first and second skew amount, it may erroneously judge the skew amount of the sheet when the sheet is being skewed and deformed.

Further, it is necessary to used a line sensor for scanning the sheets, causing manufacturing cost of the skew detecting device increase.

SUMMARY OF THE INVENTION

The present invention has been made in view of the above situations, and has as its object to provide a sheet processing apparatus capable of accurately judging skew and deformation of sheets.

Another object of the present invention is to provide a sheet processing apparatus capable of accurately feeding and processing sheets even if the sheets include one having a bent corner or a torn edge.

In order to achieve the above object, according to an aspect of the present invention, there is provided a sheet processing apparatus comprising: storing means for storing a plurality of sheets in a stacked state; means for taking in the sheets from said storing means one by one; means for feeding the sheets taken by said taking means; first and second detection means arranged in a direction perpendicular to a feeding direction of the sheets and spaced from each other, for detecting passage of the sheets; third detection means for detecting a difference between a first passing timing at which a leading edge of the sheet is detected by the first detection means and a second passing timing at which the leading edge of the sheet is detected by the second detection means based on output signals from the first and second detection means; fourth detection means for detecting a difference between a passing timing at which a trailing edge of the sheet is detected by the first detection means and a passing timing at which the trailing edge of the sheet is detected by the second detection means based on output signals from the first and second detection means; and means for judging skew of the sheet based on detection signals from the third and fourth detection means.

According to this processing apparatus, skew state of the sheet is judged by comparing the detection results of the third and fourth detection means. More specifically, if the detection results of the third and fourth detection means are different from each other, it is determined that a bent or torn portion exists in the sheet, and the detection results from the first and second detection means are not employed as inputs for controlling the operation of the apparatus. Therefore, the apparatus is not adjusted based on erroneous information, and the sheet can be processed in a stable state free from a skew, variations in feed time, and the like.

A sheet processing apparatus according to another aspect of the present invention comprises first to third detection means, disposed between the feed means and the convey means and arranged in a direction perpendicular to a convey direction of a sheet passing between the feed means and the separating means, for detecting passage of the sheet. The third detection means is provided between the first and second detection means at the same distances therefrom. A control means compares a first difference between a passing timing of the sheet detected by the firs% detection means and a passing timing of the sheet detected by the third detection means, with a second difference between the passing timing of the sheet detected by the third detection means and a passing timing of the sheet detected by the second detection means, and discriminates whether or not the detection results should be employed as control inputs to the adjusting means. If the first and second passing timings are different from each other, the control means determines that a bent or torn portion exists in the sheet, and does not employ the detection signals as the control inputs. Therefore, the gap between the feed rollers and %he separating means is not adjusted based on erroneous information, and the sheet can be processed in a stable state.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 9 show a banknote processing apparatus according to an embodiment of the present invention, in which:

FIG. 1 is a sectional view schematically showing the entire apparatus,

FIG. 2 is a perspective view showing a banknote supply section of the apparatus, FIG. 3 is a perspective view showing a roller drive unit incorporated in the banknote supply section, FIG. 4 is a block diagram schematically showing a control system of the banknote supply section, FIG. 5 is a schematic view showing the positional relationship between sensors and media in the banknote supply section, FIG. 6 is a timing chart showing the detecting operation of a medium which is being conveyed, FIG. 7 is a schematic view showing the positional relationship between sensors and a torn medium in the banknote supply section, FIG. 8 is a timing chart showing the detecting operation of the torn medium which is being conveyed, and FIG. 9 is a flow chart showing the detecting operation of the medium which is being conveyed; and FIGS. 10 to 14 show a banknote supply section having a detecting section according to a modification of the present invention, in which:

FIG. 10 is a schematic view showing the positional relationship between sensors and a medium in the banknote supply section, FIG. 11 is a timing chart showing the detecting operation of a medium which is being conveyed, FIG. 12 is a schematic view showing the positional relationship between sensors and a torn medium in the banknote supply section, FIG. 13 is a timing chart showing the detecting operation of the medium which is being conveyed.

DETAILED DESCRIPTION OF THE PREFERRED EMBODIMENT

A preferred embodiment of the present invention applied to a banknote processing apparatus will be described in detail with reference to the accompanying drawings.

Figure 1:
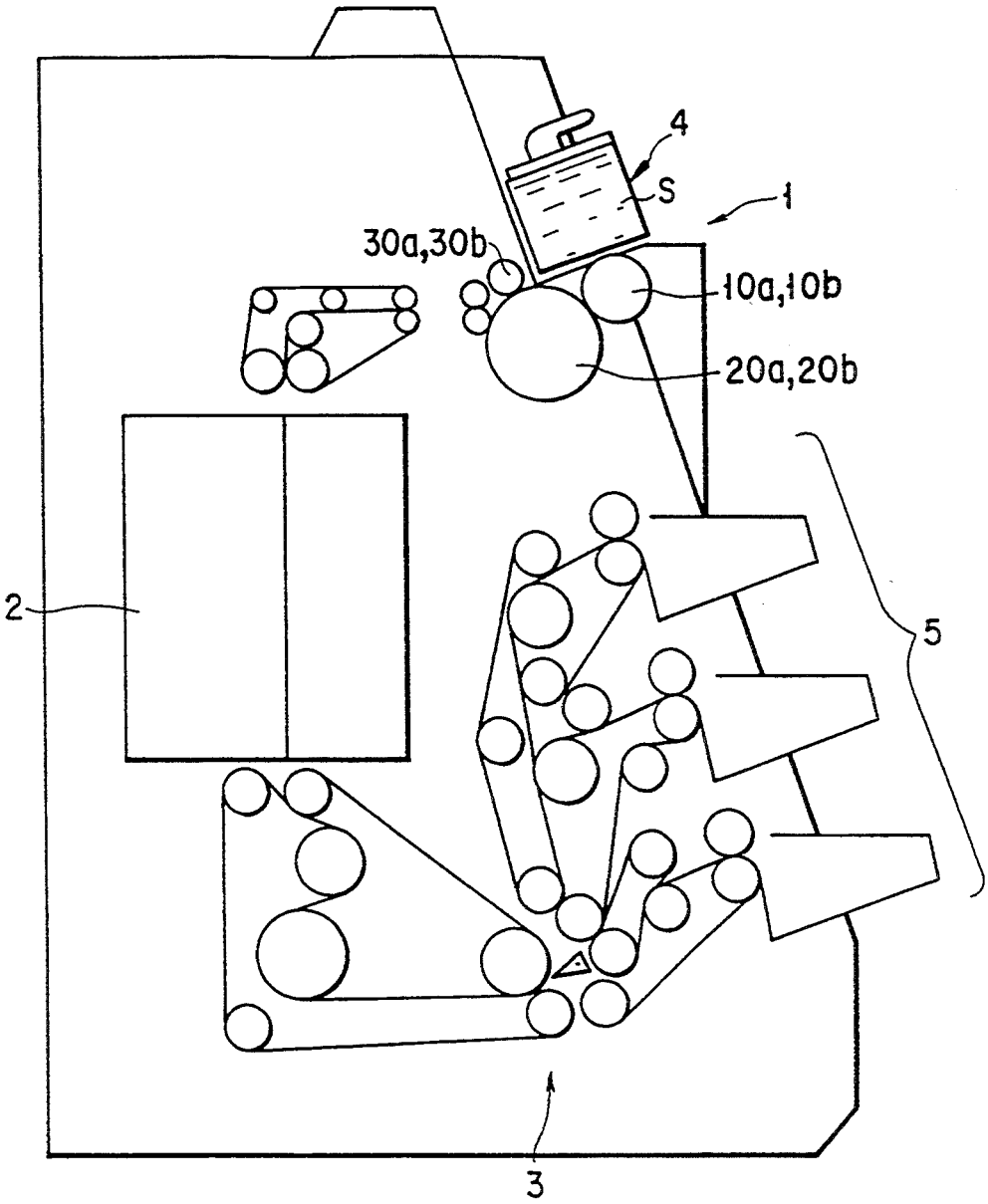

As shown in FIG. 1, the banknote processing apparatus comprises a banknote supply section 1 in which banknotes S to be processed are set in a stacked state, a discriminating section 2 for discriminating the denomination, the damage, and the authenticity of banknotes supplied from the banknote supply section 1, and for counting those banknotes, a sorting section 3 for sorting the banknotes in accordance with the discrimination result, and a totaling section 5 for storing the sorted banknotes.

Figure 2:
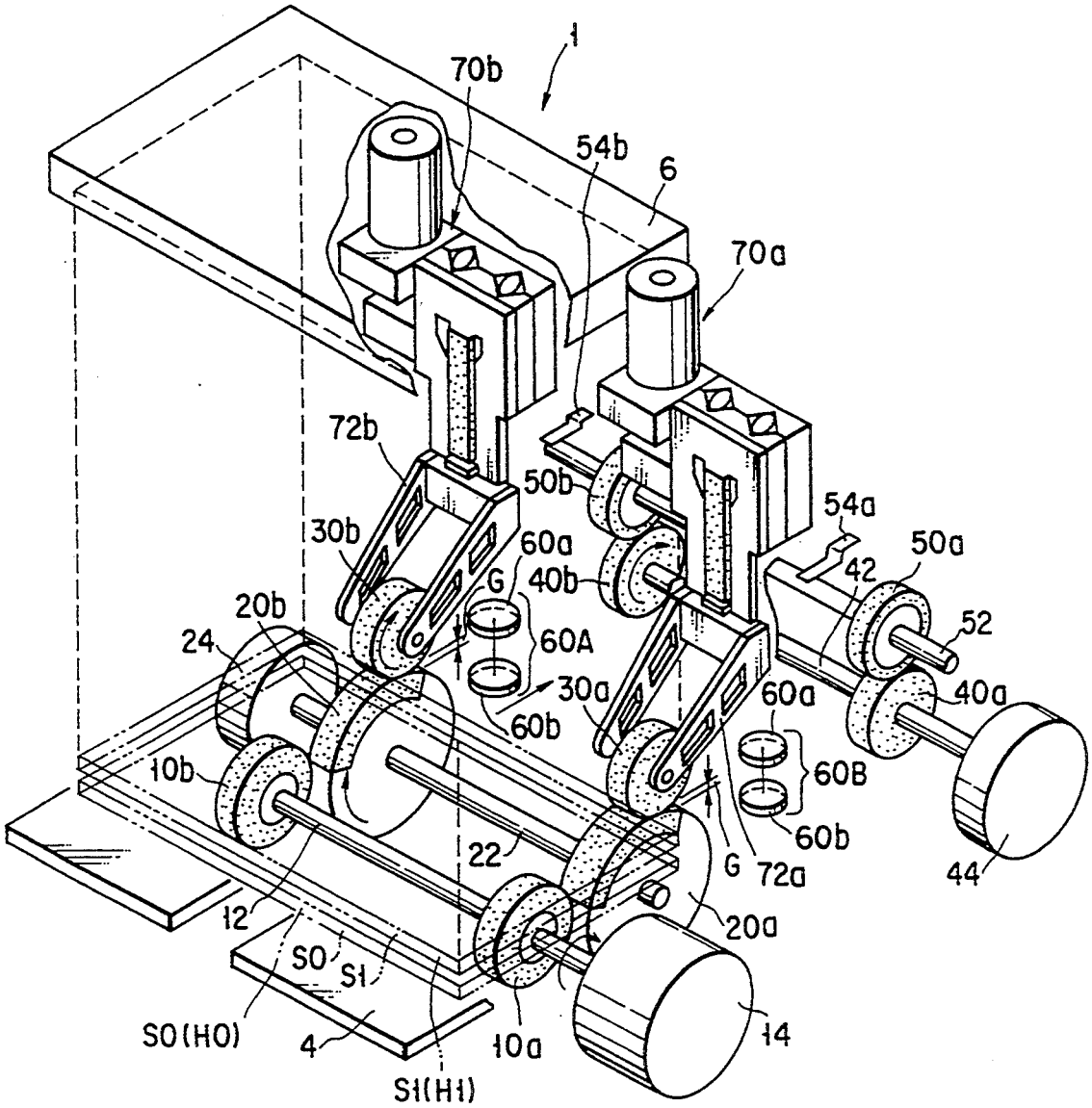

As shown in FIG. 2, the banknote supply section 1 has a banknote plate 4 on which the banknotes S are placed in the stacked state as sheets to be processed. A backup 6 for applying a desired load to the placed banknotes S is arranged to oppose the banknote plate 4. The supply section 1 also has a plurality of rollers (to be described later) for feeding the banknotes S placed on the banknote plate 4, and a display (not shown) for displaying the operating state of the processing apparatus, desired information, and the like.

A pair of pick-up rollers 10*b* and 10*b* for picking up the banknotes S from the banknote plate 4 are disposed below the banknote plate 4. A material having a high coefficient of friction, e.g., rubber is adhered to the outer circumferential surface of each roller. The pick-up rollers 10*a* and 10*b* are apart from each other by a predetermined distance in a direction perpendicular to the banknote feeding direction. The rollers 10*a* and 10*b* are connected to a stepping motor 14 through a shaft 12 extending perpendicularly to the banknote feeding direction, and are rotated by the stepping motor 14 at a predetermined speed. The pick-up rollers 10*a* and 10*b* can contact the lowermost banknote through openings (not shown) formed in the banknote plate 4.

A pair of take-in rollers 20*a* and 20*b* for taking the picked-up banknote into the processing apparatus are disposed ahead of the rollers 10*a* and 10*b* in the pick-up direction of the banknotes S. A material having a high coefficient of friction., e.g., rubber is adhered to the outer circumferential surface of each roller. The rollers 20*a* and 20*b* are spaced from each other by a predetermined distance in a direction perpendicular to the banknote feeding direction. The take-in rollers 20*a* and 20*b* are connected to a stepping motor 24 through a shaft 22 extending perpendicularly to the banknote feeding direction, and are rotated by the stepping motor 24 at a predetermined speed.

Gate rollers 30*a* and 30*b* are disposed above the take-in rollers 20*a* and 20*b* with gaps G, respectively. The gate rollers 30*a* and 30*b* prevent more than one banknotes picked up by the pick-up rollers 10*a* and 10*b* from being fed simultaneously. A material having a high coefficient of friction, e.g, rubber is adhered to the outer circumferential surface of each of the gate rollers 30*a* and 30*b*. The gate rollers 30*a* and 30*b* are respectively connected to roller drive mechanisms or units 70*a* and 70*b* (to be described later) so that they are vertically movable independently of each other.

A pair of feed rollers 40*a* and 40*b* for feeding the banknotes passing between the take-in rollers and the gate rollers toward the discriminating section 2 are disposed on the downstream of the feed rollers 20*a* and 20*b* with respect to the feeding direction of the banknotes S. The feed rollers 40*a* and 40*b* are apart from each other by a predetermined distance in a direction perpendicular to the banknote feeding direction. The feed rollers 40*a* and 40*b* are connected to a stepping motor 44 through a shaft 42 extending perpendicularly to the banknote feeding direction, and are rotated by the stepping motor 44 at a predetermined speed.

Pinch rollers 50*a* and 50*b* in rolling contact with the feed rollers 40*a* and 40*b* are disposed respectively above the feed rollers 40*a* and 40*b*. The pinch rollers 50*a* and 50*b* are supported by a shaft 52 extending perpendicularly to the banknote feeding direction. The shaft 52 is biased by plate springs 54*a* and 54*b* so that the pinch rollers 50*a* and 50*b* are urged against the opposite feed rollers 40*a* and 40*b* with a desired pressure and rotated as the feed rollers rotate.

First and second sensors 60A and 60B for detecting the feeding state of the banknotes S, e.g., skew or feed pitch variations (variations in time required for feeding out the banknote) are provided between the take-in rollers and the feed rollers. The sensors 60A and 60B are spaced from each other by a predetermined distance in a direction perpendicular to the feeding direction of the banknotes S.

Each of the sensors 60A and 60B is provided with a photointerrupter having light-emitting and light-receiving portions 60*a* and 60*b* opposing each other at a predetermined gap. Each sensor detects the banknote feeding state by utilizing the fact that light emitted by the light-emitting portion 60*a* toward the light-receiving portion 60*b* is interrupted by the banknote when the banknote passes between the light-emitting and light-receiving portions.

Figure 3:
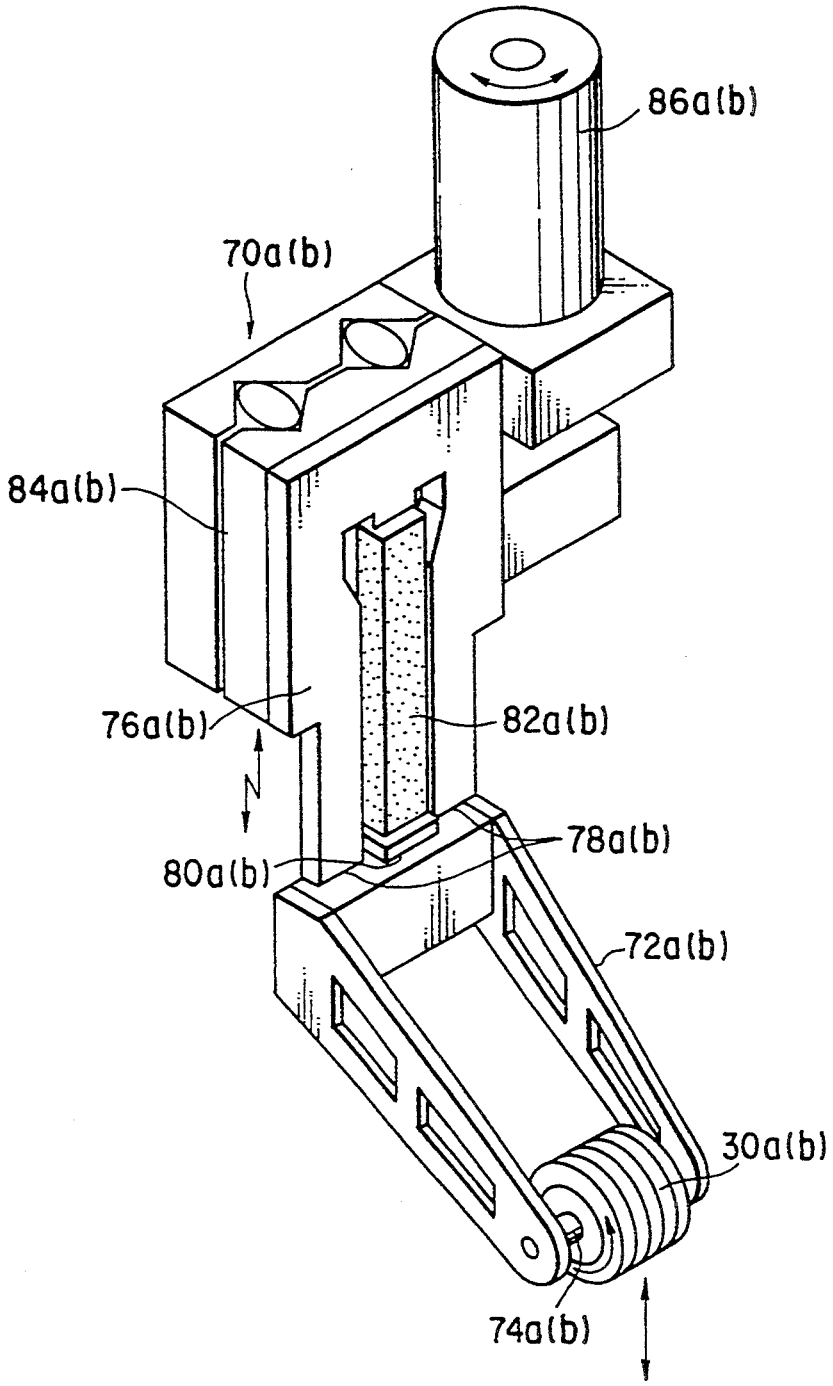

Roller drive units 70*a* and 70*b* for vertically moving the gate rollers 30*a* and 30*b* will be described. Since the roller drive units 70*a* and 70*b* have the same arrangement, the roller drive unit 70*a* representative of these two will be described. As shown in FIG. 3, the roller drive unit 70*a* has a pair of levers 72*a* for rotatably supporting the gate roller 30*a*. The gate roller 30*a* incorporates a one-way clutch, and is supported on the levers 72*a* through a shaft 74*a* so as to be rotatable only in a direction opposite to the feeding direction of the banknotes S.

The levers 72*a* are supported on a stationary plate 76*a* through a pair of plate springs 78*a*. A parallel plate spring 80*a* located between the plate springs 78*a* is fixed to the levers 72*a* and is connected to the stationary plate 76*a* through a piezoelectric element 82*a*.

The piezoelectric element 82*a* can be displaced for a maximum of about 15 μm in accordance with a voltage applied thereto. The displacement of the piezoelectric element 82*a* is enlarged to a maximum of about 300 μm in accordance with the distance between the parallel plate spring 80*a* and the levers 72*a*, and the ratio of this distance to the size of the levers 72*a*.

The stationary plate 76*a* is fixed to a stage 84*a*, and the stage 84*a* is vertically driven by a stepping motor 86*a* independently. Accordingly, the gate roller 30*a* is moved in a direction perpendicular to the surface of the banknote S by operating the piezoelectric element 82*a* and the stepping motor 86*a*, and the gap G between the take-in roller 20*a* and gate roller 30*a* is adjusted to a value optimum for banknote conveyance.

Figure 4:
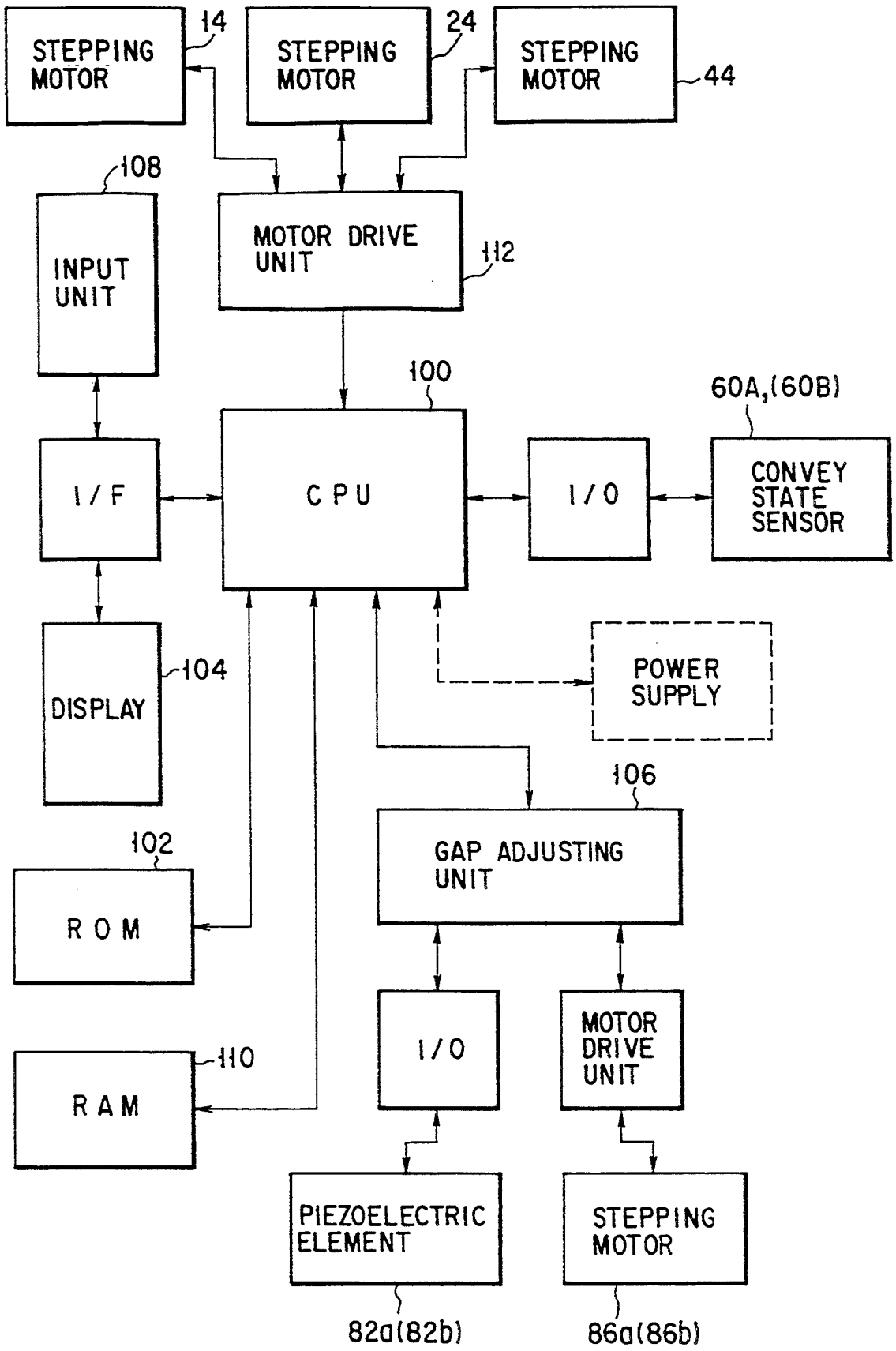

FIG. 4 schematically shows the arrangement of the banknote processing apparatus. More specifically, the processing apparatus has a main controller (CPU) 100 which is connected to a ROM 102, a display 104, a gap adjusting unit 106, an input unit 108, a RAM 110, and the like. The ROM 102 stores control information and various types of data necessary for operating the processing apparatus. The display 104 displays the current operating state of the processing apparatus. The gap adjusting unit 106 adjusts the gaps G to an optimum size by operating the roller driving units 70*a* and 70*b* (the piezoelectric elements 82*a* and 82*b*, and the stepping motors 86*a* and 86*b*) based on the feeding information sent from the first and second sensors 60A and 60B that detect the banknote feeding state. The input unit 108 performs switching between at least two predetermined operating states, e.g., an apparatus adjusting mode and a normal processing mode. The RAM 110 stores conditions or data set in the adjusting mode.

The CPU 100 is also connected to a motor drive unit 112 for driving the stepping motors 14, 24 and 44 which rotate the pick-up rollers 10*a* and 10*b*, the take-up rollers 20*a* and 20*b*, and the feed rollers 40*a* and 40*b*, respectively, and the discriminating section 2, the sorting section 3, the totaling section 5, and so on. Interfaces and input/output circuits are provided between the CPU 100 and the respective units.

The operation of the banknote processing apparatus having the arrangement as described above, and the sequence of adjusting the gaps G will be described.

When the processing apparatus is to be shipped from the factory, or when the processing apparatus is set up in an environment in which the apparatus is actually utilized, the input unit 108 is turned on to set the adjusting mode. In the adjusting mode, the rotary or movable portions of the respective units are driven at a low speed of about ½ that of the normal processing mode in accordance with the control of the CPU 100. In adjustment, in place of the banknotes S, adjusting standard media H having comparatively stable characteristics are used.

The standard media H set on the banknote plate 4 in a stacked state are urged against the pick-up rollers 10*a* and 10*b* by the load of the backup 6. When the media H are set on the banknote plate 4, the roller driving units 70*a* and 70*b* are operated independently or simultaneously by the gap adjusting unit 106, and the gaps G between the take-up rollers 20*a* and 30*b* and the gate rollers 30*a* and 30*b* are set to a desired size.

When the pick-up rollers 10*a* and 10*b* are rotated, the plurality of media H are sequentially picked up one by one, starting from a lowermost medium H0, by the rollers 10*a* and 10*b* toward the take-up rollers 20*a* and 20*b*. When media H1 and H2 located at the second position and above it when counted from the lowermost one are picked up together with the lowermost medium H0, the lowermost medium H0 is conveyed in the rotating direction of the take-in rollers 20*a* and 20*b* by the frictional force supplied from the rollers 20*a* and 20*b*. The media H1 and H2 are stopped by the frictional force supplied from the gate rollers 30*a* and 30*b* that are rotatable only in a direction opposite to that of the take-in rollers 20*a* and 20*b*.

When the standard medium H passes through the gaps G between the take-in rollers 20*a* and 20*b* and the gate rollers 30*a* and 30*b*, the feeding state of the standard medium H is detected by the first and second sensors 60A and 60B, and the detection signals of the sensors are sent to the CPU 100.

The feeding state of the standard medium H is detected by the first and the second sensors 60A and 60B in accordance with the following method.

Figure 5:
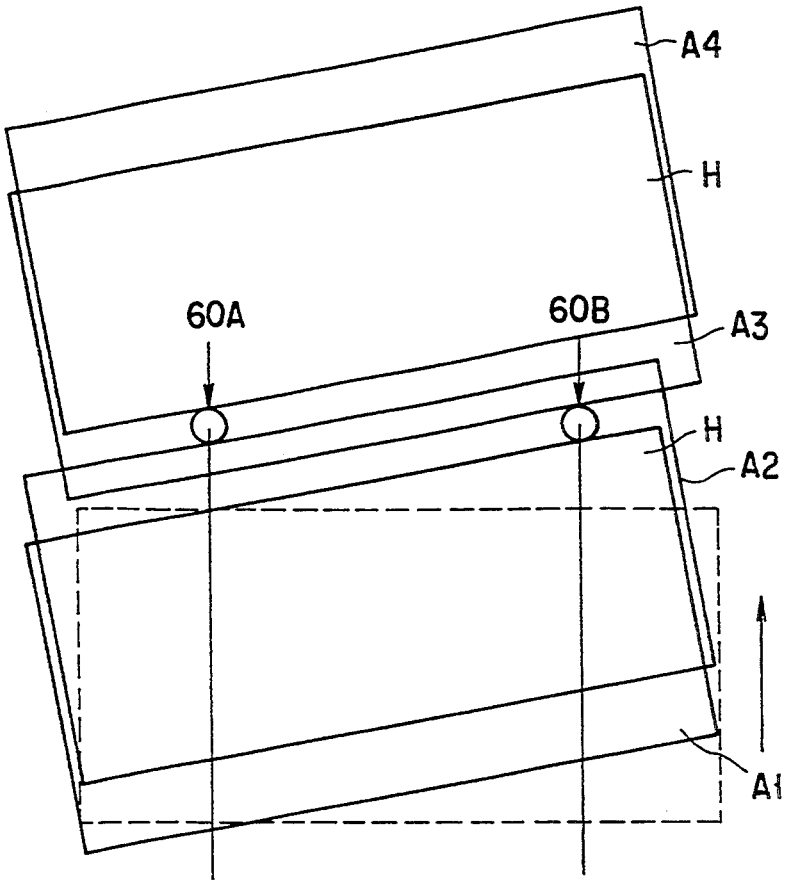
Figure 6:
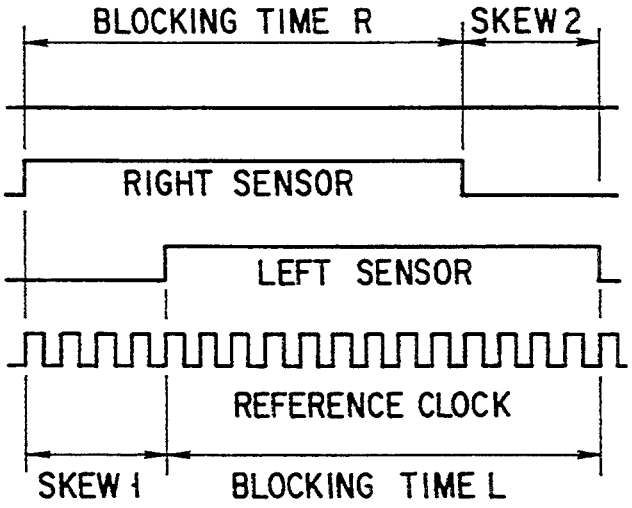

As shown in FIGS. 5 and 6, the feed pitch variations (pick-up time variations) of the standard medium H is detected by comparing a predetermined value with the pick-up time period, required after transmission of a reference signal indicating feed start until detection of the leading end of the standard medium H in the feeding direction by the first and second sensors 60A and 60B.

The skew (inclination of the medium with respect to the feeding direction) amount of the medium H is detected based on a time period required after the leading end of the medium blocks the optical path of one of the sensors 60A and 60B until it blocks the optical path of the other of the sensors 60A and 60B. More specifically, when the medium H is correctly conveyed and the skew amount is zero, as indicated by a broken line in FIG. 5, the leading end of the medium H blocks the optical paths of the first and second sensors 60A and 60B simultaneously. When the standard medium H has a skew as indicated by a solid line in FIG. 5, a time difference (skew 1) exists after the leading end of the medium blocks the optical path of the sensor 60B (A1) until it blocks the optical path of the sensor 60A (A2). The skew amount is measured based on this time difference.

A time period during which the medium H blocks the eft and right sensors 60A and 60B and a reference time determined by the length of the medium H in the feeding direction and the feed speed of the medium H are compared, thereby detecting the presence of a torn portion or a bent corner of the medium H.

More specifically, as shown in FIG. 6, blocking time periods L and R during which the medium H blocks the left and right sensors 60A and 60B, respectively, are equal (L=R) to each other unless the medium H has a torn portion or a bent corner, and take a constant value obtained by dividing the length of the medium H in the feeding direction by the feed speed. Similarly, a time difference (skew 2) after the trailing end of the medium H passes the sensor 60B (A3) until it passes the sensor 60A (A4) is equal to the skew 1.

Figure 7:
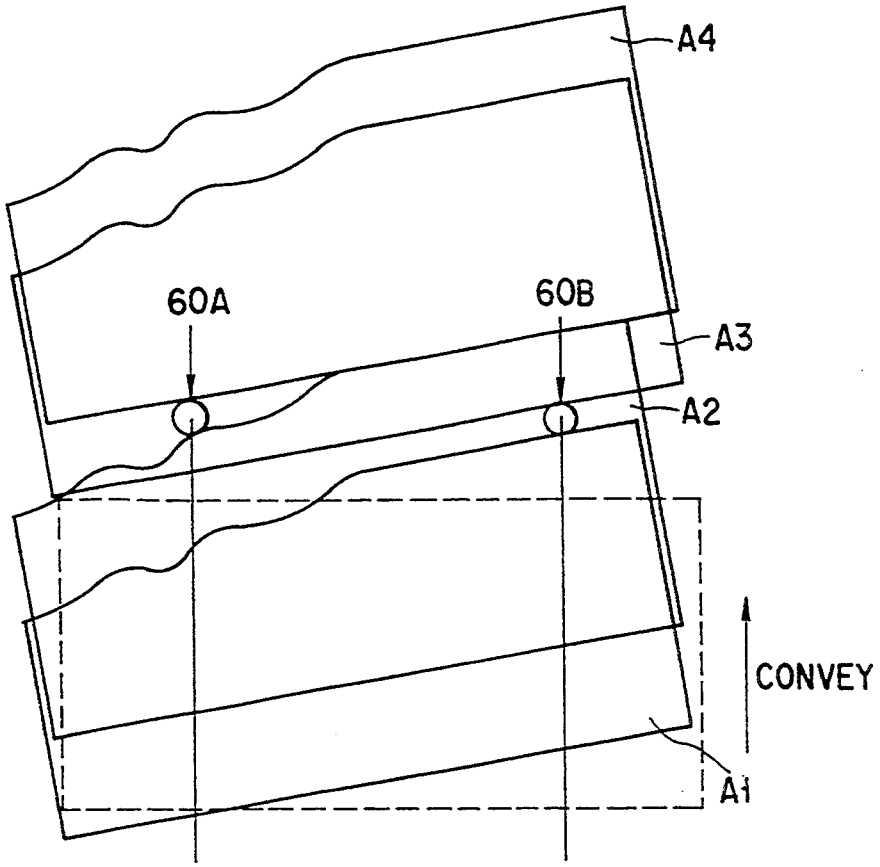
Figure 8:
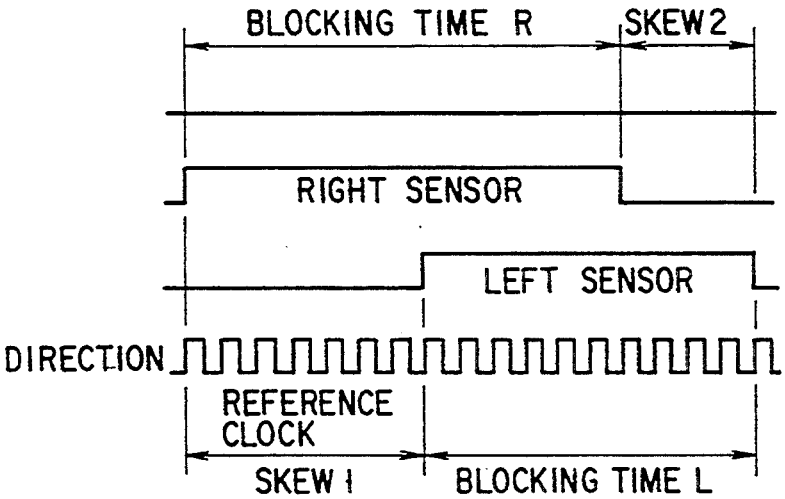

On the other hand, as shown in FIGS. 7 and 8, if the medium H has a torn portion or a bent corner, blocking time periods L and R during which the medium H blocks the left and right sensors 60A and 60B, respectively, are different from each other (L≠R), and the skews 1 and 2 are different from each other. Accordingly, from this detection result, determination as to whether or not feed pitch variations and skew of the medium H are erroneously detected due to torn portion or bent corner of the standard medium H can be performed.

When the CPU 100 determines that the feeding state of the medium H, e.g., pick-up time variations and the skew, is erroneously detected due to a torn portion or bent corner of the medium H, the state of the medium H detected by the sensors 60A and 60B is not employed as a control input of the gap adjusting unit 106. As a result, erroneous information will not be used as a control input, so that stable gap control can be performed.

Figure 9:
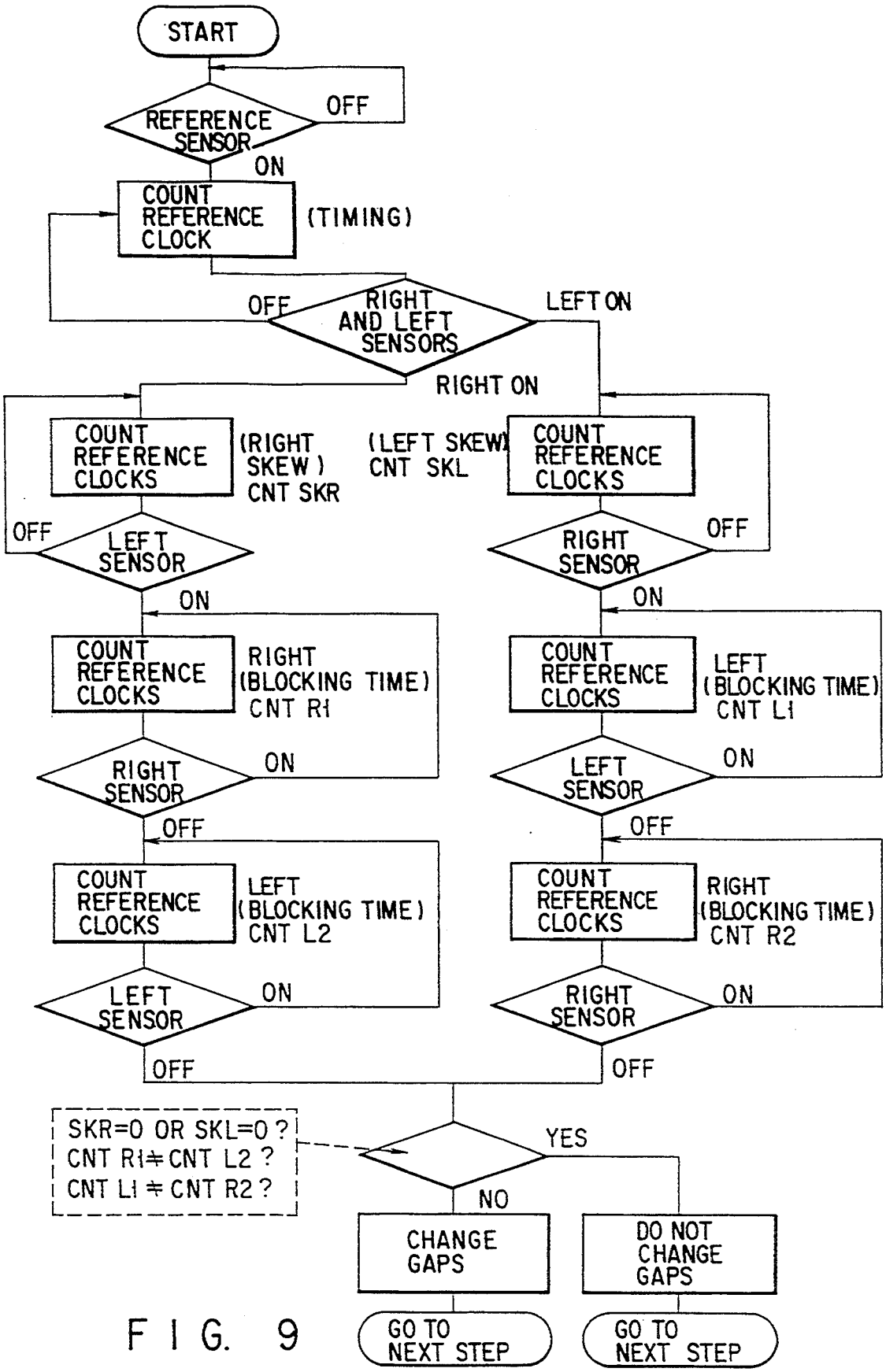

FIG. 9 is a flow chart showing detection of the medium pick-up timing and detection of the skew information.

When pick-up operation of the medium H is started, the reference sensor is turned on, and reference clocks (timing) are counted. A count obtained when at least one of the sensors 60A and 60B is turned on is read out, and the pick-up time of the standard medium H is detected. After, e.g., the right sensor 60B is turned on by the medium H, counting of the reference clocks is started. When the left sensor 60A is turned on by the medium H, the count is read out, and the Eight skew (SKR) of the medium is detected based on this count. Thereafter, the reference clocks are continuously counted. When the right sensor 60B is turned off, the count is read out, and a right blocking time period R1 is detected based on this count. When the reference clocks are further counted and the left sensor 60A is turned off, a count obtained after the left sensor 60B is turned on until it is turned off is read out, and a left blocking time period L2 is detected based on this count.

If the right skew SKR is not zero, and if the right blocking time periods R1 and L2 are equal to each other upon comparison, the CPU 100 changes the gap G between the take-in roller 20*a* and the gate roller 30*a*, and the gap G between the take-in roller 20*b* and the gate roller 30*b*. Then, the flow advances to the next step.

If the right skew SKR is zero, or if the right blocking time R1 and the left blocking time L2 are different from each other, the CPU 100 does not change the gaps G and carries out the next step.

If the pick-up operation of the medium H is started and the left sensor 60A is turned on by the medium H prior to the right sensor 60B, a left skew SKL, a left blocking time period L1, and a right blocking time period R2 are detected in the same manner as that described above.

If the left skew SKL is not zero, and if the left and right blocking time periods L1 and R2 are equal to each other upon comparison, the CPU 100 changes the gap G between the take-in roller 20*a* and the gate roller 30*a*, and the gap G between the take-in roller 20*b* and the gate roller 30*b*. Then, the flow advances to the next step.

If the left skew SKL is zero, or if the left and right blocking time periods L1 and R2 are different from each other, the CPU 100 does not change the gaps G and carries out the next step.

As described above, when a detection signal of the feeding state is output from the left or right sensor 60A or 60B, a gap control command for biasing the roller drive unit 70*a* or 70*b* serving as a gap adjusting unit 106 is output from a signal processing circuit (not shown), and at least one of the roller drive units 70*a* and 70*b* is driven.

For example, when a right skew SKR is detected, the stepping motor 86*a* of the roller drive unit 70*a* is driven to move the stage 84*a* downward in a direction perpendicular to the surface of the medium H. Then, the gate roller 30*a* is moved toward the take-in roller 20*a*, and the gap G between the gate roller 30*a* and the takein roller 20*a* is adjusted comparatively roughly. Successively, a desired voltage is applied to the piezoelectric element 82*a*, and the levers 72*a* are moved for a maximum of about 300 μm in a direction perpendicular to the surface of the medium H. Therefore, the gate roller 30*a* is moved toward the take-in roller 20*a*, and the gap G is adjusted to an appropriate size for the banknotes S passing therethrough, i.e., so that it can provide friction necessary for preventing the skew. In the adjusting mode, the voltage applied to the piezoelectric elements 82*a* and 82*b* and the drive pulse applied to the stepping motors 86*a* and 86*b* are adjusted within an enlarged range of, e.g., about twice that of the normal mode (to be described later). Therefore, a sufficiently wide adjustment margin that can cope with various types of changes over time or environmental changes can be obtained when compared to the adjustment margin of the normal processing mode.

The medium H that has been separated as a single sheet upon passing through the gaps G is conveyed toward the feed rollers 40*a* and 40*b* after its skew or pitch variations present when the medium H was placed on the banknote plate 4 is almost removed. When the medium H passes between the feed rollers 40*a* and 40*b* and the pinch rollers 50*a* and 50*b* and is discharged from the feed rollers, its skew or pitch variations are reliably removed, and is sequentially conveyed to the following discriminating section 2, sorting section 3, and totaling section 5.

This series of operations is repeatedly executed for all the media H placed on the banknote plate 4. When adjustment of the gaps G is completed in accordance with the skew or pitch variations of the media H, this fact is displayed on the display 104. Simultaneously, conditions or data set :in the apparatus adjusting mode is stored in the RAM 110.

When all the adjusting operations and storing operations to the RAM 110 in the adjusting mode are completed, the display 104 displays that the preset adjusting mode should be canceled through the input unit 108. When the input unit 108 is turned off, adjustment of the gaps G is completed. Simultaneously, the flow returns to the normal processing mode.

The banknote processing apparatus shipped from the factory is set in the normal processing mode. The normal processing mode will briefly be explained.

In the normal processing mode, banknotes S set on the banknote plate 4 in a stacked state are urged against the pick-up rollers 10*a* and 10*b* by the load of the backup 6. When the banknotes S are set on the banknote plate 4, data concerning the gaps G and stored in the RAM 110 is read out through the CPU 100. The CPU 100 operates the roller drive units 70*a* and 70*b* on the basis of the data read out from the RAM 110 and adjusts the gaps G. Then, an operation similar to that regarding the standard medium H in the adjusting mode is performed for the banknotes S at a high speed of about twice that in the adjusting mode. In this case, the gaps G are maintained in a state which is reliably adjusted at a relatively low speed in the adjusting mode. Thus, the banknotes S are processed stably and at a high speed without causing feed pitch variations or skew.

Figure 10:
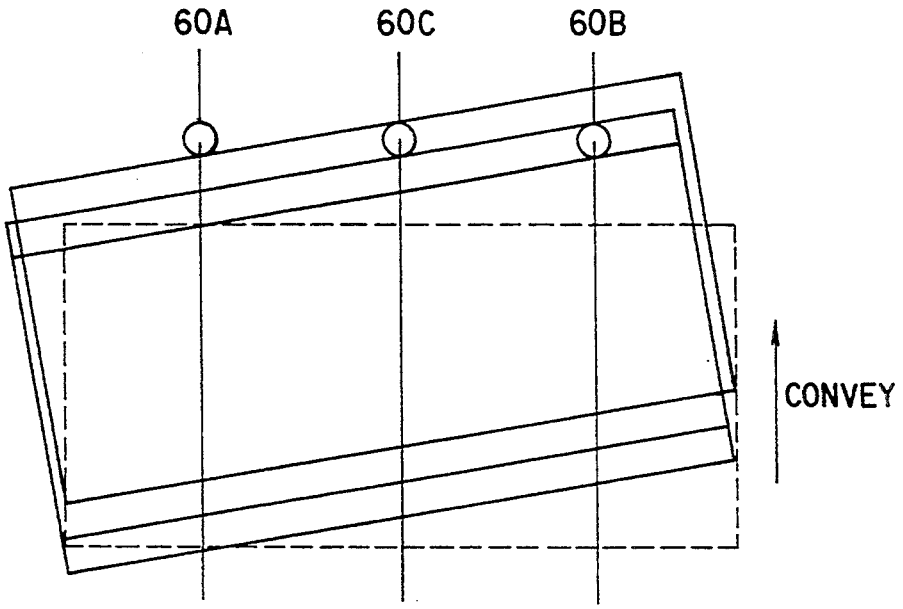

As shown in FIG. 10, in addition to the first and second sensors 60A and 60B provided to oppose the side portions of the medium H to be conveyed, the detecting section for detecting the banknote feeding state may have a central sensor 60C serving as a third detector provided between the first and second sensors 60A and 60B. The sensors 60A, 60B, and 60C are arranged in a row in a direction perpendicular to the banknote feeding direction. The distance between the sensors 60A and 60B, and that between the sensors 60A and 60C are set equal to each other.

More specifically, when a medium H passes through the gaps between light-emitting portions 60*a* and light-receiving portions 60*b* of the left, right, and central sensors 60A, 60B, and 60C, feed time periods required after a pick-up reference signal is transmitted until the leading end of a fed banknote S blocks at least one of the optical paths of the left and right sensors 60A and 60B are detected, and the banknote feed time variations are obtained based on the detection result.

The skew amounts (to be respectively referred to as skews 1 and 2) of the banknote are detected from a time period required after the leading end of the banknote S blocks one of the left and right sensors 60A and 60B, e.g., the sensor 60A until it blocks the central sensor 60C and a time period required after the leading end of the banknote S passes the central sensor 60C until it blocks the sensor 60B.

The presence/absence of a torn portion, a bent corner, and the like of the medium H is detected by comparing the values of the skews 1 and 2. Further, time periods (blocking times L, R, C) during which the medium H blocks the left, right and center sensors 60A, 60B and 60C, respectively, and a reference time determined by the length of the medium H in the feeding direction and the feed speed of the medium H are compared, thereby detecting the presence of a torn portion or a bent corner of the medium H.

Figure 11:
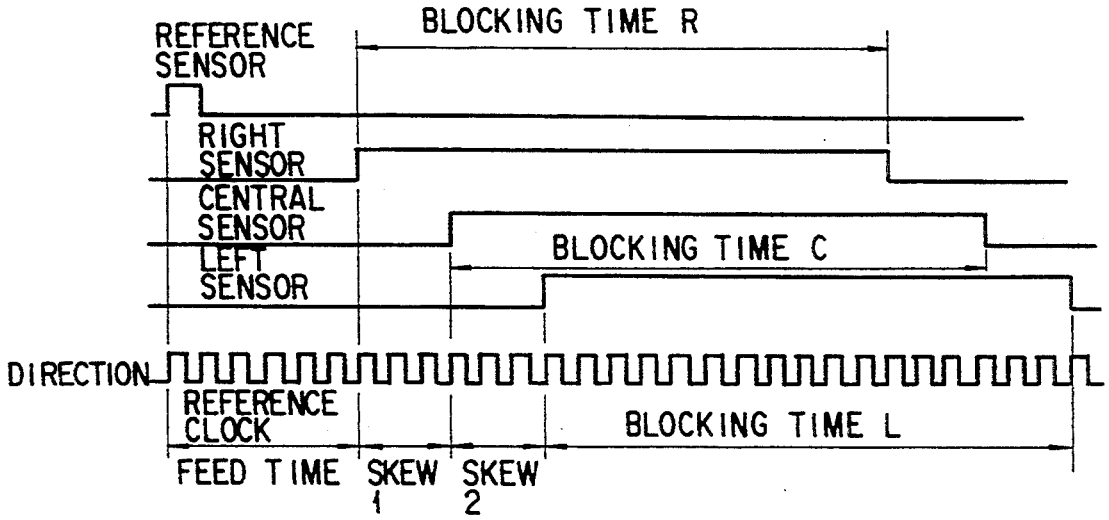
Figure 12:
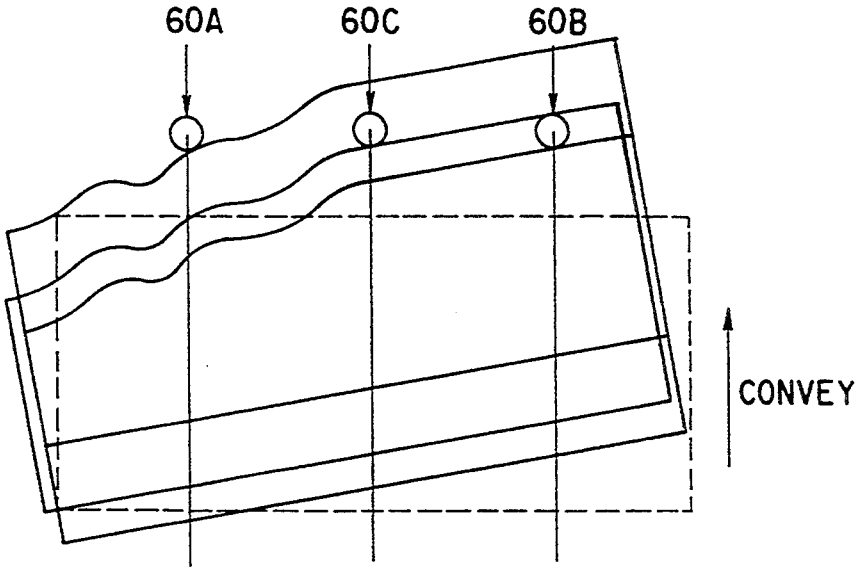
Figure 13:
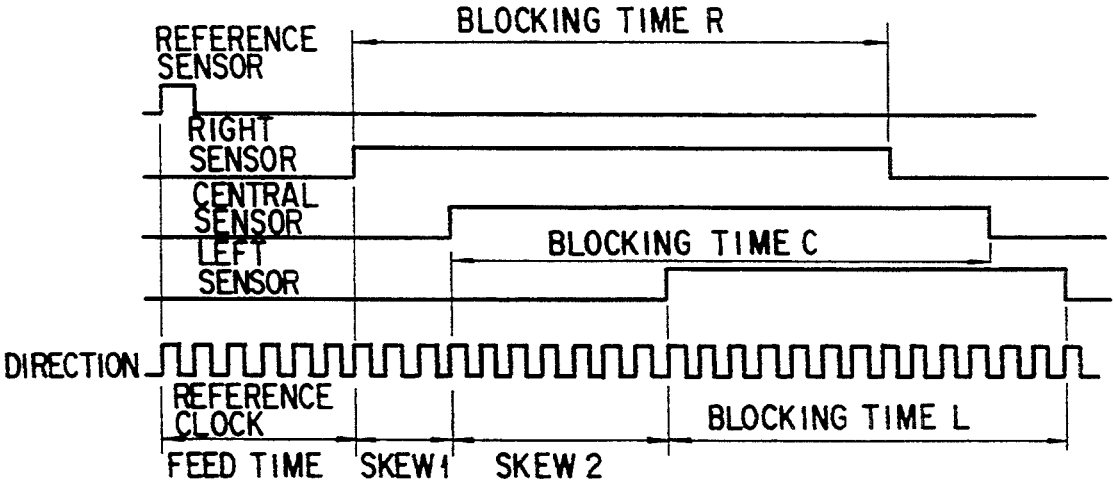

More specifically, as shown in FIGS. 10 and 11, if the banknote S does not have a torn portion or a bent corner, the values of the skews 1 and 2 are equal to each other, and the blocking times L, R, and C are equal to one another (R=L=C) and take a constant value obtained by dividing the length of the medium H in the feeding direction by the feed speed. As shown in FIGS. 12 and 13, if the banknote S has a torn portion or a bent corner, the values of the skews 1 and 2 become different. Therefore, whether or not the feeding state, e.g., feed pitch variations and skew, is erroneously detected due to a torn portion or bent corner of the banknote S can be determined from this detection result. When the CPU 100 determines that the feeding state is erroneously detected, it does not employ the feeding state of the banknote S detected by the left, right, and central sensors 60A, 60B, and 60C as a control input. As a result, the gaps G can be stably controlled not on the basis of erroneously information.

Figure 14A:
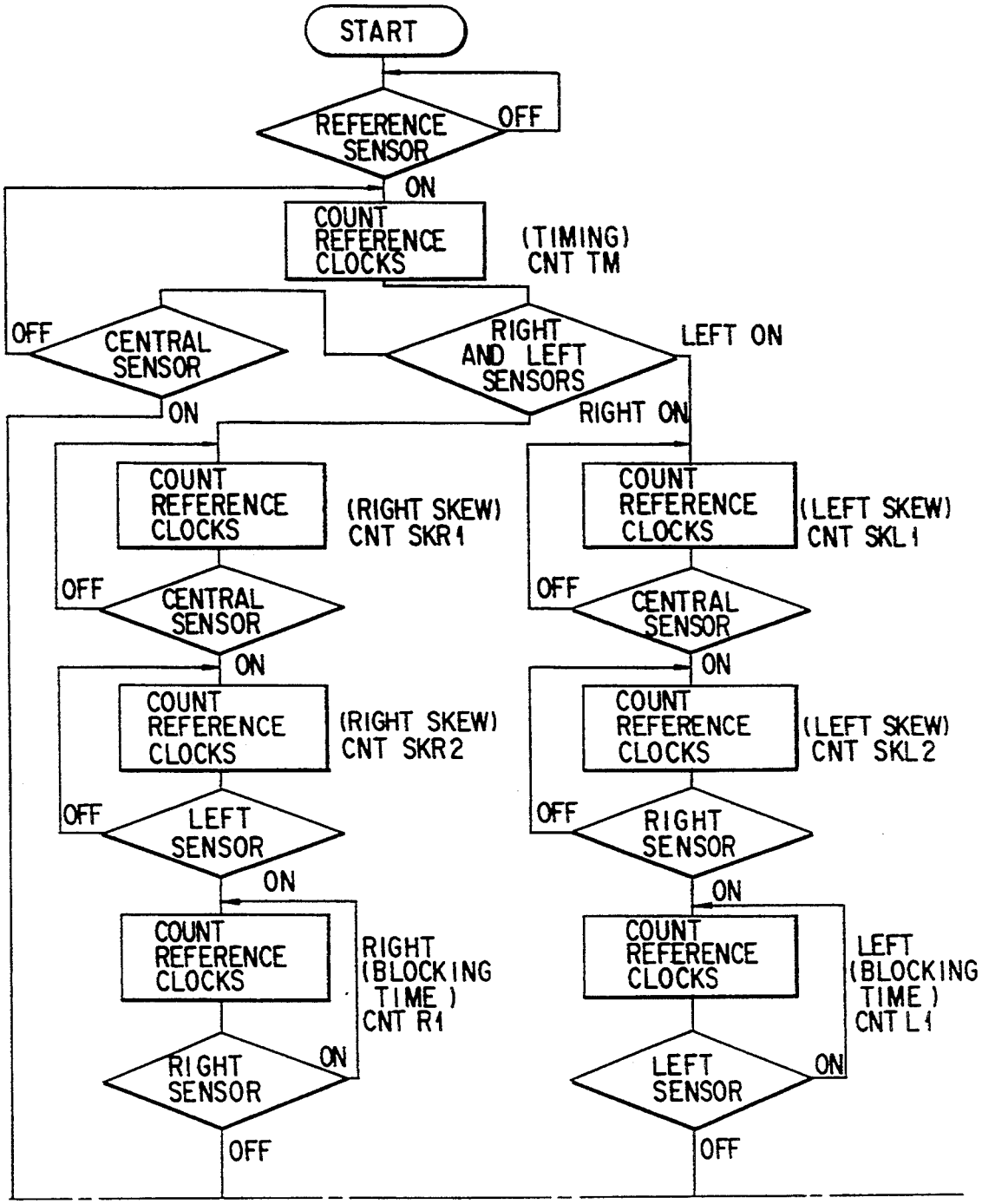
FIGS. 14A and 14B are a flow chart showing the detecting operation of a medium which is being conveyed.
Figure 14B:
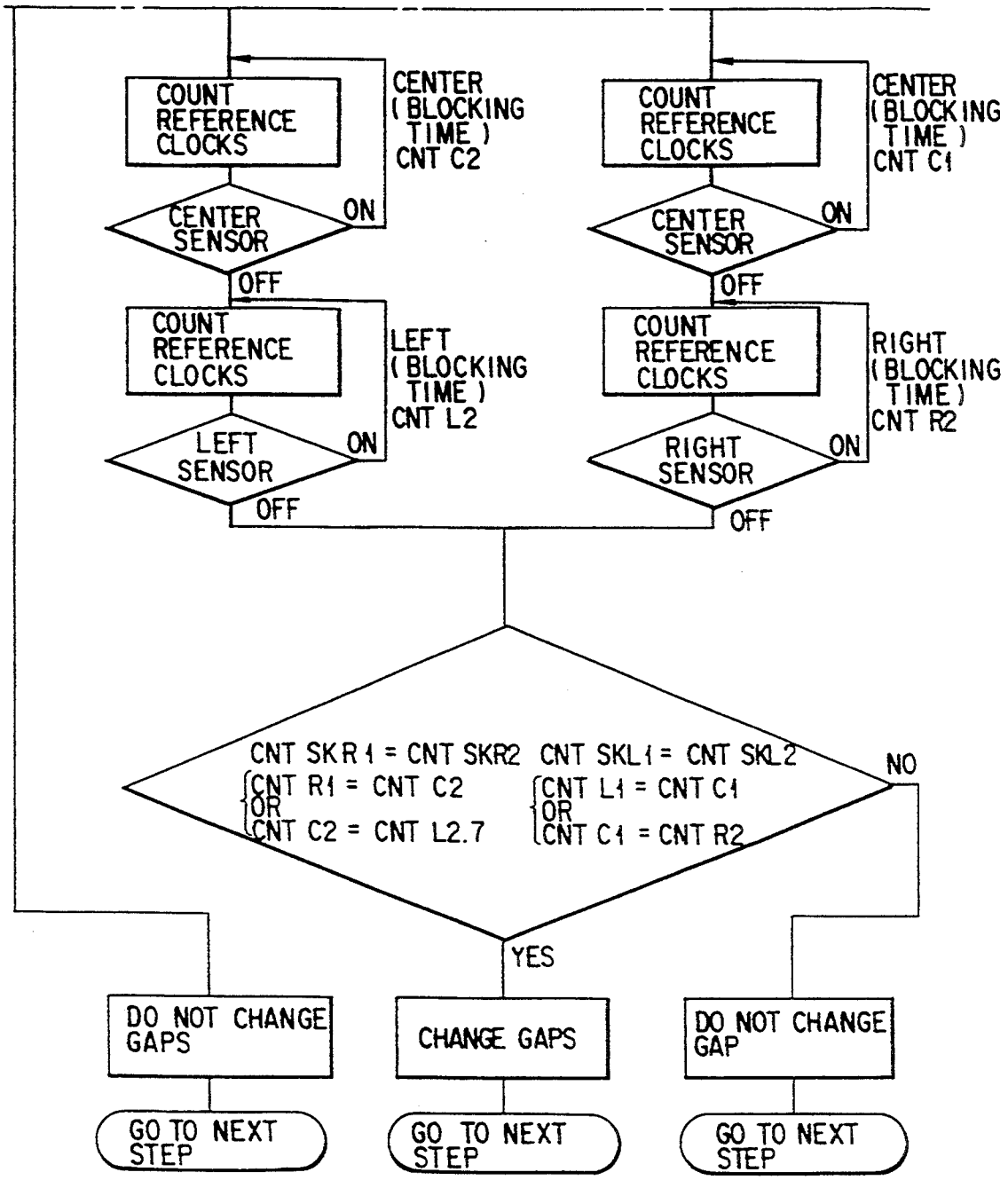

FIGS. 14A and 14B are a flow chart in accordance with which the feed timing and the skew information of the medium are detected.

When a feed operation of a banknote S is started, the reference sensor is turned on, and the reference clocks (timing) are counted. When, e.g., the right sensor 60B is turned on by the banknote S, the count is read out, thereby detecting the feed time. After the right sensor 60B is turned on, when the central sensor 60C is turned on by the banknote, the count of the reference clocks is read out, and the right skew 1 is detected based on this count. Subsequently, reference clocks are continuously counted, the count of the reference clocks obtained after the central sensor 60C is turned on until the left sensor 60A is turned on is read out, and the right skew 2 is detected based on this count.

Thereafter, the reference clocks are continuously counted. When the right sensor 60B is turned off, the count is read out, and a right blocking time period R1 is detected based on this count. When the reference clocks are further counted and the center sensor 60C is turned off, a count obtained after the center sensor 60C is turned on until it is turned off is read out, and a center blocking time period C2 is detected based on this count. When the reference clocks are further counted and the left sensor 60A is turned off, a count obtained after the left sensor 60A is turned on until it is turned off is read out, and a left blocking time period L2 is detected based on this count.

If the right skews 1 and 2 are equal to each other, the CPU 100 changes the gap G between the take-in roller 20*a* and the gate roller 30*a*, and the gap G between the take-in roller 20*b* and the gate roller 30*b* such that the skew is eliminated. Then, the flow advances to the next step. If the right skews 1 and 2 are different, the CPU 100 determines that the feed information is erroneous. Then, the flow advances to the next step without changing the gaps G by the CPU 100.

After the feed operation of the banknote S is started, if the left sensor 60A is turned on by the banknote prior to the right sensor 60B, the feed time, the left skews 1 and 2, and blocking time periods L, C and R are sequentially detected in the same manner to that described above. If the left skews 1 and 2 are equal to each other, the CPU 100 changes the gaps G so that the left skew is eliminated. If the left skews 1 and 2 are different, the flow advances to the next step without changing the gaps G.

If the left and right sensors 60A and 60B and the central sensor 60C are turned on simultaneously by a banknote S, this banknote S does not have a skew. Then, the flow advances to the next step without changing the gaps G by the CPU 100.

According to the banknote processing apparatus having the arrangement as described above, the banknote feeding state is detected, and whether or not the detection result can be employed as a control input is determined. Hence, erroneous information caused by a bent or torn portion of a banknote will not be input as control information, and the gap between the take-in rollers and the gate rollers can be accurately adjusted. Thus, a banknote processing apparatus capable of stably feeding out and processing banknotes can be provided.

The present invention is not limited to the embodiment described above, and various changes and modifications may be made within the spirit and scope of the invention. For example, the sheet processing apparatus according to the present invention is not limited to one utilized in a banking facility, e.g., a bank, but can be utilized in an ATM (Automatic Teller Machine) or a CD machine used for cash transaction with a customer.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A sheet processing apparatus comprising:

storing means for storing a plurality of sheets in a stacked state;

means for taking in the sheets from said storing means one by one;

means for feeding the sheets taken by said taking means;

first and second detection means arranged in a direction perpendicular to a feeding direction of the sheets, for detecting passage of the sheets;

third detection means for detecting a difference between a first passing timing at which a leading edge of the sheet is detected by the first detection means and a second passing timing at which the leading edge of the sheet is detected by the second detection means based on output signals from the first and second detection means;

fourth detection means for detecting a difference between a passing timing at which a trailing edge of the sheet is detected by the first detection means and a passing timing at which the trailing edge of the sheet is detected by the second detection means based on output signals from the first and second detection means; and means for judging skew of the sheet based on detection results of the third and fourth detection means.

2. An apparatus according to claim 1, which further comprises separating means, opposing said taking means with a gap therebetween, for separating the sheets taken by said taking means and passing through the gap one by one; and adjusting means for adjusting the gap between said separating means and said taking means based on detection results from said first and second detection means.

3. An apparatus according to claim 2, wherein each of said first and second detection means comprises a sensor, having light-emitting and light-receiving portions disposed to oppose each other, for detecting passage of the sheet when an optical path between said light-emitting and light-receiving portions is blocked by the sheet.

4. An apparatus according to claim 3, which further comprises means for comparing a first time period during which the optical path of the light-emitting and light-receiving portions of the first detection means is blocked by the sheet and a second time period during which the optical path of the light-emitting and light-receiving portions of the second detection means is blocked by the sheet, with a reference time obtained from a length of the sheet in the feeding direction and a feed speed of the sheet, and supplying the detection results from the first and second detection means to the adjusting means when the first and second time periods are equal to the reference time, respectively.

5. An apparatus according to claim 2, which further comprises means for inputting the detection results from the first and second detection means to said adjusting means when the first and second passing timing are equal to each other.

6. An apparatus according to claim 2, wherein said taking means has a take-in roller rotatable in a feeding direction of the sheets, said separating means has a gate roller opposing the take-in roller with the gap therebetween, and said adjusting means has means for moving the gate roller toward and away from the take-in roller.

7. A sheet processing apparatus comprising: storing means for storing a plurality of sheets in a stacked state;

means for taking in the sheets from said storing means one by one;

means for feeding the sheets taken by said taking means;

first and second detection means arranged in a direction perpendicular to a feeding direction of the sheets and spaced from each other, for detecting passage of the sheets;

third detection means for detecting a difference between a first passing timing at which an edge of the sheet is detected by the first detection means and a second passing timing at which the edge of the sheet is detected by the second detection means based on output signals from the first and second detection means;

fourth detection means for detecting a time period required for the passage of the sheet through the first detection means;

fifth detection means for detecting a time period required for the passage of the sheet through the second detection means; and means for judging skew of the sheet based on a detection result of the third detection means when detection results of the fourth and fifth detection means are equal to each other.

8. An apparatus according to claim 7, wherein each of said first and second detection means comprises a sensor, having light-emitting and light-receiving portions disposed to oppose each other, for detecting passage of the sheet when an optical path between said light-emitting and light-receiving portions is blocked by the sheet.

9. An apparatus according to claim 8 which further comprises;

separating means, opposing the taking means with a gap therebetween, for separating the sheets taken by said taking means and passing the separated sheets through the gap one by one;

adjusting means for adjusting the gap between said separating means and said taking means based on detection results from said first and second detection means; and means for discriminating whether or not the detection results from the first and second detection means should be employed as control inputs to said adjusting means by comparing a time period during which the optical path of the light-emitting and light-receiving portions of each of the first and second detection means is blocked by the sheets, with a reference time obtained from a length of the sheet in the feeding direction and a feed speed of the sheet.

* * * * *